United States Patent [19]

Rannikko

[11] Patent Number: 4,915,791

[45] Date of Patent: Apr. 10, 1990

[54] ROLL WITH BLADES ROTATABLY MOUNTED WITHIN IT IN THE FORMING SECTION OF A PAPER MACHINE

[75] Inventor: Jukka Rannikko, Tampere, Finland

[73] Assignee: Oy Tampella AB, Tampere, Finland

[21] Appl. No.: 344,315

[22] Filed: Apr. 27, 1989

[30] Foreign Application Priority Data

May 18, 1988 [FI] Finland ..... 882336

[51] Int. Cl.[4] ..... D21F 1/00; D21F 1/54

[52] U.S. Cl. ..... 162/351; 162/357; 162/368; 162/352; 29/121.1; 29/121.3

[58] Field of Search ..... 162/357, 351, 352, 348, 162/318, 321, 368, 370, 371, 372; 29/121.1, 121.3, 130

[56] References Cited

U.S. PATENT DOCUMENTS

| | | | |
|---|---|---|---|
| 439,538 | 10/1890 | Miller et al. | 162/368 |
| 3,111,454 | 11/1963 | Tucker et al. | 162/357 |
| 3,121,660 | 2/1964 | Hall, Jr. | 162/348 |
| 3,272,692 | 9/1966 | Hayes et al. | 162/357 |
| 3,577,315 | 5/1971 | Franklin | 162/357 |
| 3,846,232 | 11/1974 | Kankaanpaa | 162/357 |
| 3,880,711 | 4/1975 | Hayes, Jr. | 162/357 |

*Primary Examiner*—Karen M. Hastings
*Attorney, Agent, or Firm*—Ladas & Parry

[57] ABSTRACT

The invention relates to a roll (8) for the forming section of a paper machine or the like, comprising a perforated shell (17) for removing water from a fibre suspension through holes (18) in the shell (17) into the roll (8) and being arranged to be mounted rotatably in the machine. A wire (3; 10) or the like within the forming section is arranged to be in contact with the shell (17) of the roll (8) over a part of its periphery. For improving the dewatering and the formation, the roll (8) comprises, at least substantially over the peripheral portion in contact with the wire (3; 10), bladelike means (21; 33) extending in the longitudinal direction of the roll (8). The blades are positioned within the shell (17) close to the inner surface thereof and mounted in such a manner that the shell (17) moves relative to the blades when the roll (8) rotates.

6 Claims, 3 Drawing Sheets

FIG. 1
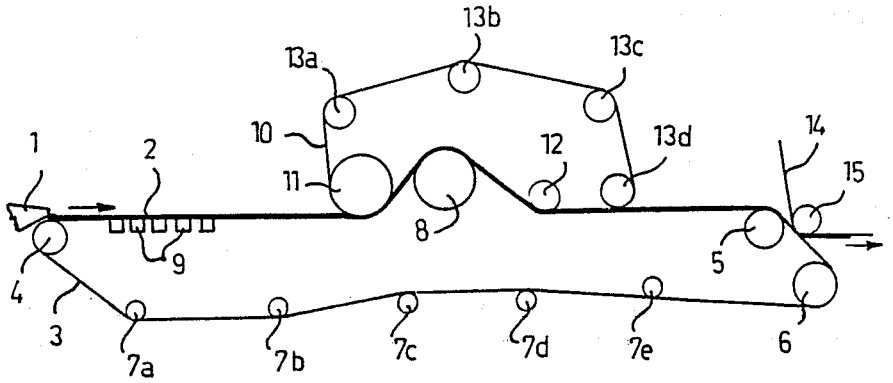
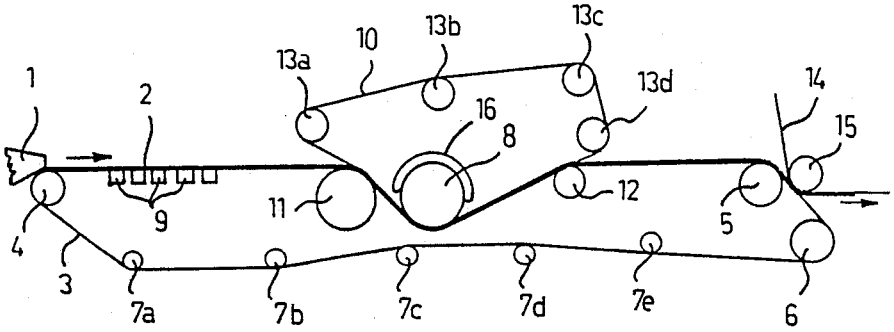
FIG. 2

FIG. 3
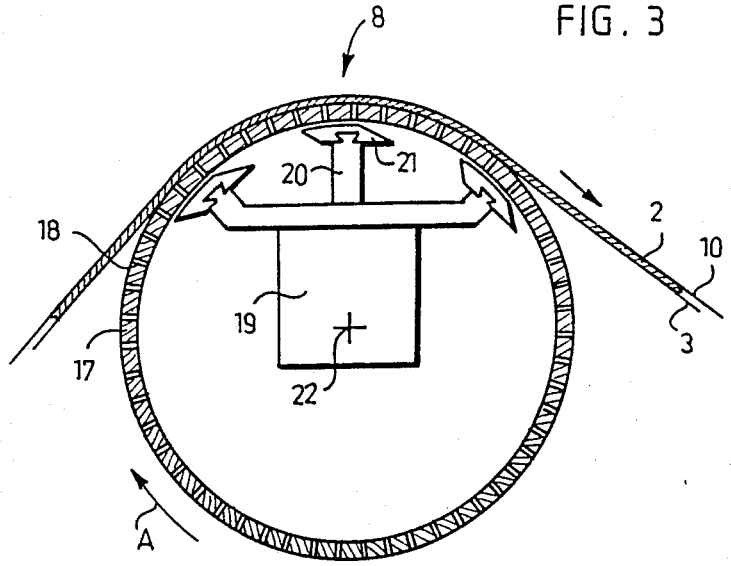
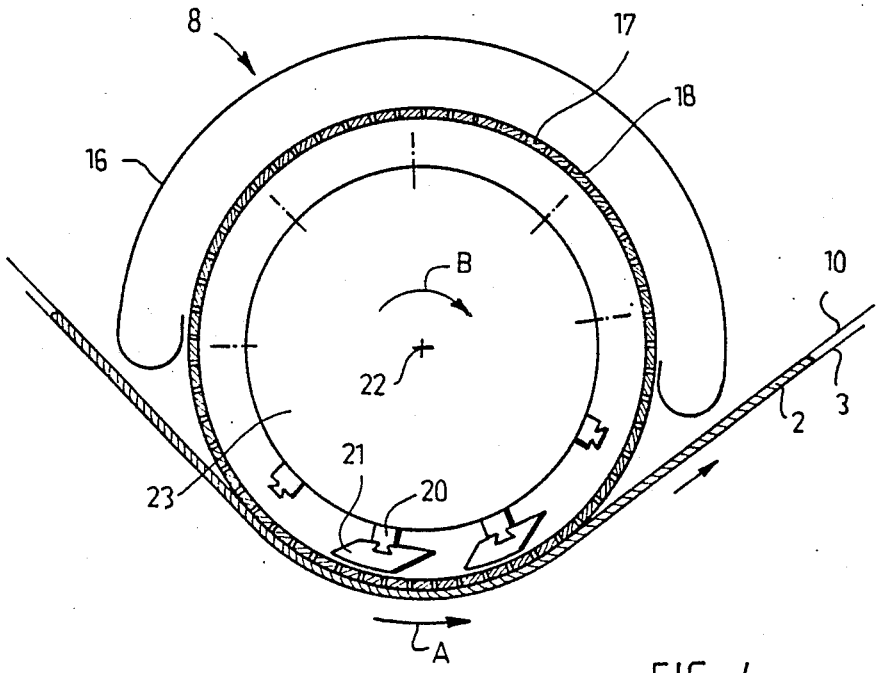
FIG. 4

ROLL WITH BLADES ROTATABLY MOUNTED WITHIN IT IN THE FORMING SECTION OF A PAPER MACHINE

The invention relates to a roll for the forming section of a paper machine or the like, comprising a perforated shell for removing water from a fibre suspension through holes in the shell into the roll and being arranged to be mounted rotatably in the machine, whereby a wire or the like within the forming section is arranged to be in contact with the shell of the roll over a part of its periphery.

Within the forming section of a paper machine or the like, fibre suspension is introduced from the head box on to a wire, whereafter water is removed from the suspension until a coherent weblike product is obtained. Dewatering is carried out by various devices, such as table rolls, foils, suction boxes, and rolls and suction rolls having a shell provided with grooves, blind bores or holes.

Finnish Patent Application No. 822705 discloses a solution in which a wire hose is provided around a grooved roll, so that water from the web enters the grooves through the wire hose and further along the grooves to be removed from the roll within a shell portion not in contact with the web. Finnish Patent Application No. 823643, in turn, discloses a solution in which means are provided inside a roll with a perforated shell by means of which only the shell portion making contact with the wire communicates with the inner space of the roll, in addition to which vacuum is created inside the roll for sucking water through the holes in the shell portion communicating with the inner space, thus making the dewatering of the web being formed more efficient. U.S. Pat. No. 3,056,719 discloses a solution in which wires move around a roll having a perforated shell, and the compression created by the wires forces water out of the web through the shell and within the roll, wherefrom it is gathered by means of a separate scraper and discharged.

A drawback of known solutions is that since the dewatering is based solely on the compression created by the wires, and possibly on gravitation, the dewatering properties of the roll are rather poor, and the removal of the water which has entered the roll is difficult. Sucking water from within the roll by means of vacuum is problematic due to the wear of seals and other structures since the roll shell portion which does not make contact with the wire has to be separated from the space under vacuum. Furthermore, separate suction means have to be provided for creating the vacuum, in which water and steam have to be separated from the air, whereby the purchase and operating costs are unreasonably high. Also, the prior art devices may be capable of dewatering a web whereas they do not affect the formation and quality of the web.

The object of the present invention is to provide a roll which enables an efficient dewatering of a web and the like within the forming section and which improves the formation and, as a consequence, the quality of the final product. This is achieved according to the invention in such a manner that the roll comprises, at least substantially over the peripheral portion in contact with the wire, bladelike means extending in the longitudinal direction of the roll, the blades being positioned within the shell close to the inner surface thereof and mounted in such a manner that the shell moves relative to the blades when the roll rotates.

The basic idea of the invention is that the roll is provided with blades positioned close to the surface of the shell, the blades moving relative to the surface of the shell while the roll rotates. When the forward edge of a blade reaches a hole in the shell, it causes an outward pressure shock from within the shell to the couching web, thus breaking the couched fibre web layer and improving the formation. Correspondingly, as the backward surface of the blade is inclined from the shell towards the centre of the roll, the vacuum effect so created causes water to be absorbed from the fibre suspension within the roll, wherefrom the water is discharged through the holes in the shell under the influence of at least the throw force caused by the centrifugal force.

BRIEF DESCRIPTION OF THE DRAWINGS

The invention will be described in more detail in the attached drawings, wherein FIG. 1 illustrates schematically the mounting of a roll according to the invention within the lower wire loop in a paper machine forming section comprising an upper wire loop;

FIG. 2 is a similar schematical view of the mounting of the roll according to the invention within the upper wire loop in a paper machine forming section comprising an upper wire loop;

FIG. 3 is a more detailed cross-sectional view of one embodiment of the roll according to the invention when mounted similarly as in FIG. 1;

FIG. 4 is a more detailed cross-sectional view of another embodiment of the roll according to the invention when mounted similarly as in FIG. 2;

DETAILED DESCRIPTION OF THE PREFERRED EMBODIMENT

Figure 5:
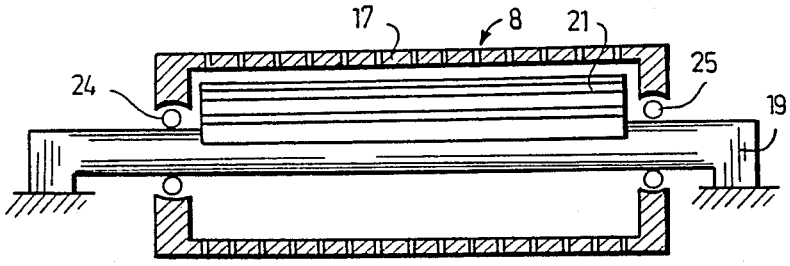
FIG. 5 is a schematical sectional view of the structure of the roll of FIG. 3 longitudinally of the roll.

FIG. 1 shows a forming section in a paper machine, that is, a wire section whereto fibre suspension is introduced from a head box 1 in the paper machine. As used in this patent application and claims, the term "paper machine or the like" refers to a machine producing a weblike product from a paper, paper board or some other fibre suspension. Fibre suspension, which is formed into a web within the forming section, is fed on to a lower wire 3 moving around turning rolls 4, 5, and 6; auxiliary rolls 7*a*–7*e*; and a dewatering roll 8. Suction boxes 9 are provided under the lower wire 3 between the head box 1 and the dewatering roll 8. The function of the suction boxes is to dewater the fibre suspension by sucking water through the wire 3. An upper wire loop 10 moving around turning rolls 11 and 12 and auxiliary rolls 13*a*–13*d* is provided above the wire 3. The two wires 3 and 10 press the web therebetween between the turning rolls 11 and 12. The formed fibre web 2 is detached from the upper wire loop 10 at the turning roll 12, being passed onwards on the lower wire 3 over a couch roll 5 on to a pick-up roll of a transfer wire 14, whereafter it is passed onwards on the transfer wire 14 into the other sections of the paper machine.

FIG. 2 shows a forming section corresponding to that shown in FIG. 1 except that the dewatering roll 8 according to the invention is therein mounted within the upper wire loop 10, the turning rolls 11 and 12 being correspondingly mounted within the lower wire loop 3. In this particular embodiment, water is removed through the wires in a downward direction due to the centrifugal force and, on the other hand, in a direction towards the inside of the roll 8 due to the suction effect. From within the roll 8, water is discharged into a separate water removal trough positioned above the roll. The other parts shown in FIG. 2 correspond in operation to those shown in FIG. 1 and are provided with the same reference numerals as in FIG. 1.

FIG. 3 is a cross-sectional view of a specific roll 8 according to the invention suitable for use in the structure of FIG. 1. The roll 8 comprises a perforated shell 17, in which there are holes 18 with desired spacing. The lower wire loop 3 is pressed against the shell 17, while the upper wire loop 10 presses the web 2 between the wires 3 and 10 against the wire 3. A support frame 19 extending longitudinally of the roll 8 and comprising fastening means 20 is provided within the shell 17. Bladelike means, in this particular case blades 21, preferably conventional foil strips known per se, are attached to each one of the fastening means 20 in a manner known per se, such as a dovetail joint. A portion of the surface of the bladelike means or blades 21 on the side of the inner surface of the shell 17 is so inclined that it diverges from the surface of the shell 17 in such a way that the backward edge of the surface portion in the direction of the movement of the shell 17 relative to the blades 21 is positioned at a greater distance from the inner surface of the shell 17 than its forward edge. The growing angle so formed creates a vacuum effect, thus making the dewatering more efficient.

In the embodiment described above, there are three foil strips or blades 21; however, their number may vary as desired depending of their size, the diameter of the roll 8 and other such matters. While the shell 17 of the roll 8 rotates in the direction of the arrow A, the holes 18 in the shell 17 pass by the foils. When the hole 18 reaches the forward edge of the foil 21, this edge creates a pressure shock in the water, which acts through the wire 3 on the surface of the shell 17, breaking the couched fibre suspension and improving the formation of the web being formed. Further, the backward edge of the foil strip, that is, its backward edge in the direction of movement of the surface of the shell 17, is at a greater distance from the inner surface of the shell 17 with respect to the forward edge thereof, whereby the surface of the blade or the foil strip on the side of the shell diverges from the shell 17 in the direction of movement of the shell, i.e., it is inclined towards the centre of the roll 8. The angle so formed creates a vacuum effect which sucks water into the holes in the wire 3 and in the shell 17 and possibly also through the holes 18, thus improving the dewatering of the web. The water which has entered the roll 8 through the holes in the shell 17 flows and drops downward under the influence of the force of gravity, being discharged from within the roll below it under the influence of the centrifugal force caused by the rotation of the shell and the force of gravity. The support frame 19 supporting the blades 21 can be mounted unrotatably with respect to the shell 17 similarly as the central frame in variable crown rolls known per se, wherein the shell is mounted on bearings arranged around the frame, whereby the structure is simple and steady. The support frame 19 may comprise several fastening means 20, so that the number of the blades can be altered if required in accordance with the quality to be run and the desired effect.

FIG. 4 is a cross-sectional view of an embodiment of the roll according to the invention suitable for use in the structure of FIG. 2. In this particular case, the upper wire loop 10 is positioned against the surface of the shell 17 while the lower wire loop 3 presses the web 2 between the wires 3 and 10 against the upper wire loop 10. As distinct from the structure of FIG. 3, an internal roll 23 rotating concentrically with an axis 22 of the roll 8 is used in combination with the roll 8, the fastening means 20 of the blade 21 being attached to the internal roll. The internal roll 23 is mounted to rotate in the direction of rotation A of the roll shell 17 or preferably in a direction B opposite thereto, whereby its influence both on the breaking of a couched web and on the dewatering of the web is efficient. These influences can be adjusted simply by varying the rate of rotation of the internal roll 23 without any mechanical measures in the blades 21. In this embodiment the pressure effect of the blades 21 at the forward edge of the blade and the suction effect at the diverging backward edge of the blade are substantially the same as in the embodiment of FIG. 3, and the water sucked within the roll shell 17 is discharged under the influence of the centrifugal force and the rotation of the blades 21 into a water removal trough 16 positioned above the roll 8 and on the sides thereof and further therefrom away from the forming section. Even though two blades 21 only are shown in the figure, it is obvious that blades can be provided in all fastening means 20 or only some of them, depending on the requirements in each particular case, provided that the internal roll 23 is balanced relative to its axis of rotation.

FIG. 5 is a schematical cross-sectional view of the roll 8 of FIG. 3 in the longitudinal direction thereof. A support frame 19 stationary with respect to the body of the paper machine is mounted in the middle of the roll 8. The roll 8 is mounted rotatably to the support frame by means of bearings 24 and 25. The shell 17 of the roll 8 rotates with the machine in a normal way, being driven by the wire 3 making contact therewith due to the friction between the wire 3 and the shell 17.

Figure 6:
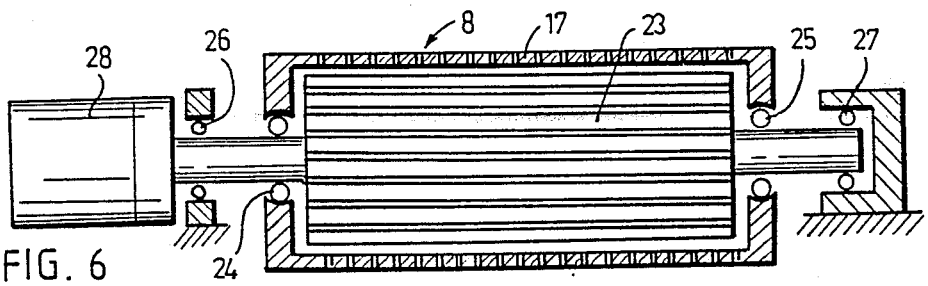
FIG. 6 is a schematical sectional view of the structure of the roll of FIG. 4 longitudinally of the roll.

FIG. 6 is a schematical cross-sectional view of the roll 8 of FIG. 4 in the longitudinal direction of the roll. The internal roll 23 is mounted rotatably with respect to the body of the paper machine by means of bearings 26 and 27. A motor 28 is connected to the internal roll 23 for rotating it, whereby the rate of rotation of the internal roll 23 can be adjusted by varying the speed of the motor. The shell of the roll 8 is mounted rotatably around the axis of the internal roll 23 similarly as in FIG. 5 by means of bearings 24 and 25. In this solution, too, the shell 17 is rotated by the wire 10 making contact therewith under the influence of the friction between the wire 10 and the shell 17.

Figure 7:
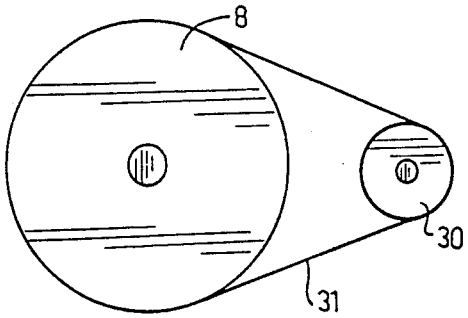
FIGS. 7 and 8 illustrate schematically the roll according to the invention, which can be mounted similarly as shown in FIG. 4 over a web positioned on the lower wire in a structure where there is no upper wire between the web and the roll.
Figure 8:
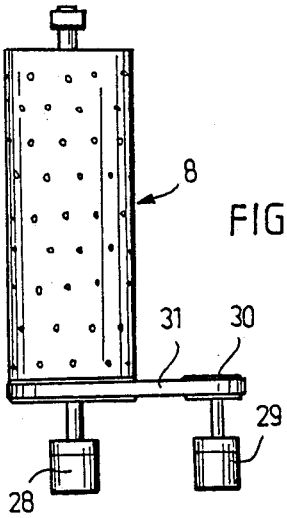

FIGS. 7 and 8 illustrate schematically the operation and structure of the roll according to the invention when the invention is applied to a solution in which no upper wire is provided but the web 2 is positioned on the lower wire 3 only. In this case, the shell of the roll 8 makes direct contact with the web 2, which does not operate to rotate the shell therewith. For this reason, a motor 29 is connected to the shell 17 for rotating it. The motor 29 rotates a band 31 going around the end of the shell through a drive wheel 30, as a result of which the shell 17 rotates, too. In this case, too, an internal roll 23 rotated by a motor 28 may, as shown in the figure, be provided within the roll 8, or a fixedly mounted unrotatable roll body 19 provided with blades 21 or the like.

Figure 9:
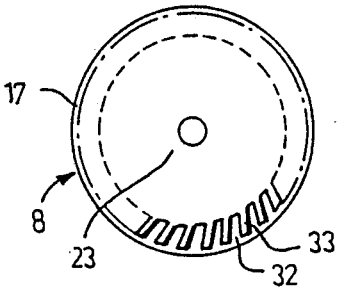
FIG. 9 illustrates still another embodiment of the roll according to the invention.

FIG. 9 shows still another embodiment of the roll according to the invention, wherein the bladelike means 21 are attached to the surface of the internal roll 23. In this particular embodiment, the internal roll 23 is provided with grooves 32 in such a manner that ridges 33 are left between the grooves. The outer surfaces of the ridges 33, that is, the surfaces facing the shell 17 are shaped similarly as corresponding surfaces in the blades 21 shown in FIGS. 3 and 4 for achieving the desired effect. As shown in FIG. 9, the grooves 32 may thus be so shaped that a sharp point is formed at the forward edge of the ridges 33, that is, at the foremost edge relative to the shell. However, this is not always necessary, but the forward edge of the ridges 33 as well as that of the blades 21 can be shaped in various ways according to the pressure effect to be obtained.

Only a few embodiments of the invention in the forming sections of various kinds have been described above, and the invention is in no way restricted to these examples. The blades 21 can be formed in various ways and their surface can likewise be shaped in various ways depending on the effect to be obtained. The number of the blades in the different embodiments depends on the shape of the blades and the effect to be obtained and can be such as desired. In place of blades, a grooved roll or roll body can be used in which ridges left between the grooves function as blades. Thereby the outer surface of the ridges, that is, the surface facing the inner surface of the shell 17 of the roll 8, is formed similarly as the blades for obtaining the same effect. Depending on the use, it is possible to use either the embodiment with a rotating internal roll or blades mounted unrotatably with respect to the body of the paper machine; in both cases, the blades may be either equal in shape or of different shapes. In place of a single roll according to the invention, it is possible to mount several such rolls within the forming section, whereby the position of the roll within the forming section and within the wire loops thereof can be as desired. The roll according to the invention may also be used on the lower wire in applications where no upper wire loop is used, whereby the roll has separate drive means for rotating it at the right speed relative to the lower wire loop.

I claim:

1. In a paper machine forming section, a roll (8) comprising a perforated shell (17) for removing water from a fibre suspension through holes (18) in the shell (17) into the roll (8), means for mounting said roll rotatably in the machine, a wire (3; 10) within the forming section arranged to be in contact with the shell (17) over a part of its periphery and to move in synchronization therewith, said roll (8) including, substantially over the entire peripheral length of said shell, bladelike means (21; 33) extending in the longitudinal direction of the roll (8), means for mounting the bladelike means rotatably with respect to the shells the bladelike means being positioned within the shell (17) close to the inner surface thereof and mounted in such a manner that the shell (17) moves relative to the bladelike means when the roll (8) rotates.

2. A roll (8) according to claim 1 including an internal roll (23) mounted within the shell (17) concentrically therewith and rotatably with respect to it, said bladelike means (21; 23) being attached to the internal roll (23).

3. A roll (8) according to claim 2, including means for mounting the internal roll (23) so as to rotate in a direction opposite to the direction of rotation of the shell (17).

4. A roll (8) according to claim 1, wherein the bladelike means (21) are formed by separate foil strips mounted substantially in parallel with the longitudinal axis (22) of the roll (8).

5. A roll (8) according to claim 2, wherein the bladelike means (33) are formed by ridges between grooves (32) formed in the surface of the internal roll (23).

6. A roll according to claim 1 wherein at least some of the bladelike means include a surface facing the shell, whereupon, on rotation of said shell relative to said surface, a point on said shell moves past said surface in a direction from a forward portion of said surface to a rearward portion of said surface, said rearward portion being inclined with respect to said forward portion and diverging away from said shell along its entire length in said direction.

* * * * *